US012318831B2

(12) United States Patent
Liasi et al.

(10) Patent No.: US 12,318,831 B2
(45) Date of Patent: Jun. 3, 2025

(54) CONTROLLABLE AND ADJUSTABLE STAMPING DRAW BEAD WITH REVERSE BEAD GEOMETRY

(71) Applicant: Ford Motor Company, Dearborn, MI (US)

(72) Inventors: Evangelos Liasi, Royal Oak, MI (US); Liang Huang, Troy, MI (US); Rudolf Gerich, Macomb Township, MI (US); Eric Frevik, Dearborn, MI (US); Christian Richard Genereux, Brighton, MI (US); Keith Zobay, Kenockee, MI (US)

(73) Assignee: Ford Motor Company, Dearborn, MI (US)

( * ) Notice: Subject to any disclaimer, the term of this patent is extended or adjusted under 35 U.S.C. 154(b) by 352 days.

(21) Appl. No.: 17/382,574

(22) Filed: Jul. 22, 2021

(65) Prior Publication Data

US 2023/0026889 A1 Jan. 26, 2023

(51) Int. Cl.
*B21D 22/02* (2006.01)
*B21D 37/10* (2006.01)

(52) U.S. Cl.
CPC ..... *B21D 22/02* (2013.01); *B21D 37/10* (2013.01)

(58) Field of Classification Search
CPC ..... B21D 22/02; B21D 37/10; B21D 22/20; B21D 22/22; B21D 24/04
USPC ..... 72/350, 347–348
See application file for complete search history.

(56) References Cited

U.S. PATENT DOCUMENTS

| | | | | |
|---|---|---|---|---|
| 4,531,395 | A * | 7/1985 | Dusman | B21D 22/22 72/341 |
| 5,005,396 | A * | 4/1991 | DeSmet | B21D 22/10 72/347 |
| 9,662,700 | B2 * | 5/2017 | Taguchi | H01M 8/0206 |
| 9,908,168 | B2 * | 3/2018 | Liebel | B23K 26/38 |
| 2011/0094283 | A1 * | 4/2011 | Flehmig | B21D 22/22 72/347 |
| 2022/0126345 | A1 * | 4/2022 | Sohmshetty | G01N 21/8851 |

FOREIGN PATENT DOCUMENTS

| | | |
|---|---|---|
| CN | 102151752 | 9/2012 |
| CN | 104174743 | 3/2016 |
| CN | 107626802 | 1/2018 |
| FR | 2467645 | * 10/1998 |
| KR | 20080005977 | * 12/2008 |

* cited by examiner

*Primary Examiner* — Adam J Eiseman
*Assistant Examiner* — Fred C Hammers
(74) *Attorney, Agent, or Firm* — Burris Law, PLLC

(57) ABSTRACT

A forming die includes a first die component with a male bead and a second die component with a female bead. The male bead and the female bead form a bead with a reverse bead geometry with the male bead having a groove and the female bead having a protrusion complimentary with the groove such that the protrusion is aligned with the groove when the male bead extends into the female bead. Also, the protrusion is adjustable in real-time within the female bead. A stamping machine with the first die component and the second die component has a control unit configured to adjust the protrusion in real-time as a function of mechanical property testing data, width testing data, thickness testing data, lubrication testing data and/or image sensor module data on one or more blanks to be stamped and/or one or more blanks that have been stamped.

20 Claims, 10 Drawing Sheets

CONTROLLABLE AND ADJUSTABLE STAMPING DRAW BEAD WITH REVERSE BEAD GEOMETRY

FIELD

The present disclosure relates to forming dies and particularly to forming dies beads to control inflow.

BACKGROUND

The statements in this section merely provide background information related to the present disclosure and may not constitute prior art.

Forming dies plastically deform sheet metal blank (also known as "blanks") into desired shapes or profiles and are used for the manufacture of various parts or components such as vehicle hoods, door panels, and fenders, among others. In some forming dies, a "bead" is included and is a design feature that functions to control metal flow of a panel being deformed during a forming operation. Particularly, the bead enhances "panel stretch" of the panel during a forming operation and thereby enhances panel quality for attributes such as dent resistance, dimensional stability and surface appearance.

Traditional beads have a female bead portion (referred to herein simply as a "female bead") and a complimentary male bead portion (referred to herein simply as a "male bead") such that the panel flows into the female bead and around the male bead during the forming operation. Also, depth of the male bead, and radii of both the female bead and the male bead, are geometric parameters that set or control a restraining force on the panel during the forming operation. Particularly, increasing the depth of the female bead and/or decreasing the radii of the female and male bead increases the restraining force on a panel during a forming operation. However, the thickness and mechanical properties of the panel limit the depth of the male bead and the radii of the female and male dies. Accordingly, forming dies with "double beads" are used to provide such desired restraining forces.

In addition, properties of sheet metal panels may vary from batch to batch and thus result in variations in components formed with a given set of forming dies.

The present disclosure addresses the issues of forming dies with beads among other issues related to forming dies.

SUMMARY

This section provides a general summary of the disclosure and is not a comprehensive disclosure of its full scope or all of its features.

In one form of the present disclosure, a forming die includes a first die component with a male bead and a second die component with a female bead. The male bead and the female bead form a bead with a reverse bead geometry with the male bead having a groove and the female bead having a protrusion complimentary with the groove such that the protrusion is aligned with the groove when the male bead extends into the female bead. Also, the protrusion is adjustable in real-time within the female bead.

In some variations, the protrusion extends along a length of the female bead and has at least one slot. In such variations the forming die includes an attachment member extending at least partially through the at least one slot such that the protrusion is moveably captured within the female bead. In at least one variation, the at least one slot extends in a transverse direction through the protrusion and the attachment member extends normal to a direction of travel of the protrusion. Also, the second die component can include a first aperture on one side of the female bead and a second aperture co-axial with the first aperture on another side of the female bead, and the attachment member can extend through the first aperture of the second die component, through the at least one slot of the protrusion, and be mechanically engaged with the second aperture on the another side of the female bead. For example, in some variations the attachment member is a threaded fastener, the second aperture is a threaded hole, and the threaded fastener extends through the first aperture of the second die component, through the at least one slot of the protrusion, and is threadingly engaged with the threaded hole on the another side of the female bead.

In at least one variation, the protrusion has a first position within the female bead configured for a maximum target inflow within a predefined production window and a second position within the female bead configured for a minimum target inflow within the predefined production window.

In some variations, a stamping machine (also referred to herein as a "press machine") with the first die component and the second die component is included, and a control unit is configured to receive data on a blank to be stamped with the stamping machine. In such variations, the data is at least one of mechanical property testing data on the blank to be stamped, width testing data on the blank to be stamped, thickness testing data on the blank to be stamped, lubrication testing data for lubrication on the blank to be stamped, and finite element analysis (FEA) versus actual draw comparison data on the blank to be stamped. Also, the control unit is configured to adjust at least one of a cushion tonnage and a stamping speed of the stamping machine in real-time as a function of the received data. In the alternative, or in addition to, the control unit is configured to adjust a position of the protrusion in real-time as a function of the received data. In some variations, the control unit is configured to adjust, in real-time, a position of the protrusion between a first position within the female bead configured for a maximum target inflow within a predefined production window and a second position within the female bead configured for a minimum target inflow within the predefined production window.

In at least one variation a stamping line with the forming die is provided.

In another form of the present disclosure, a sheet metal stamping press line includes a blank width measurement detector, a blank thickness measurement detector, a lubrication measurement detector, and a stamping press machine configured to stamp press a plurality of sheet blanks. The stamping press machine includes a first die component with a male bead and a second die component with a female bead, and the male bead and the female bead form a bead with a reverse bead geometry with the male bead having a groove and the female bead having a protrusion complimentary with the groove such that the protrusion is aligned with the groove when the male bead extends into the female bead. Also, the protrusion is adjustable within the female bead. The stamping press machine also includes a control unit configured to adjust, in real-time, at least one of a cushion tonnage of the sheet metal stamping press machine, a stamping speed of the sheet metal stamping press machine, and a position of the protrusion.

In some variations, the blank width measurement detector is configured to transmit width measurement data on a blank to be stamped, the blank thickness measurement detector is configured to transmit thickness measurement data the blank to be stamped, and the lubrication measurement detector is configured to lubrication measurement data on the blank to be stamped. In such variations, the control unit is configured to receive the width measurement data on the blank to be stamped, the blank thickness measurement data on the blank to be stamped, and the lubrication measurement data on the blank to be stamped, and adjust, in real-time, the cushion tonnage of the stamping press machine, the stamping speed of the stamping press machine, and the position of the protrusion as function of at least one of the received width measurement data, the received thickness measurement data, and the received lubrication measurement data.

In at least one variation, the sheet metal stamping press line further includes a draw analysis camera configured to capture images of a stamped blank and compare the captured images to a finite element analysis of the stamped blank. In such variations, the draw analysis camera can be configured to transmit the comparison of the captured image of the stamped blank to the finite element analysis of the stamped blank to the control unit. And in some variations the control unit is configured to receive the comparison of the captured image of the stamped blank to the finite element analysis of the stamped blank and adjust, in real-time, the cushion tonnage of the stamping press machine, the stamping speed of the stamping press machine, and the position of the protrusion as function of the comparison of the captured image of the stamped blank to the finite element analysis of the stamped blank.

In some variations, the control unit is configured to modify a production window of stamping a subsequent blank as function of the comparison of the captured image of the stamped blank to the finite element analysis of the stamped blank.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
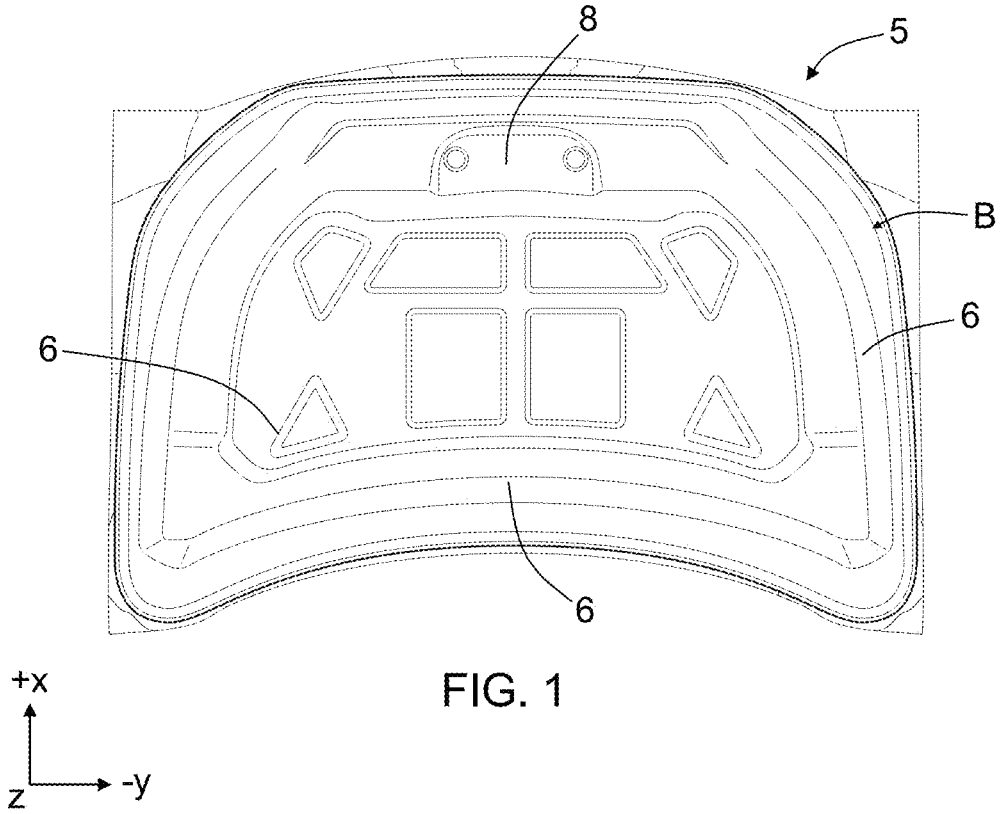
FIG. 1 is a plan view of a hood panel for a vehicle.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a hood panel 5 for a vehicle (not shown) formed from a sheet metal blank 'B' is shown. The hood panel 5 includes several contours 6 and regions 8 that are formed between at least one pair of forming dies (not shown in FIG. 1) that plastically deform the sheet metal blank B into a desired shape as shown in FIG. 1. Stated differently, the hood panel 5 is formed using a stamping or pressing process where the phrase "stamping process" and term "stamping" refers to placing generally flat sheet metal, either in blank or coil form, into a stamping press where a tool and a die surface (i.e., a pair of forming dies) form the flat sheet metal into a desired net shape.

It should be understood that stamping of components such as the hood panel 5, and other components used for the manufacture or assembly of vehicles, can be a complex process that includes multiple stamping steps in order to obtain a desired final shape. Also, stamping of a sheet metal blank B is affected by variables such as yield strength of the sheet metal blank before and/or during stamping, ultimate tensile strength of the sheet metal blank before and/or during stamping, ductility of the sheet metal blank before and/or during stamping, thickness of the sheet metal blank, type of lubrication applied to the sheet metal blank before stamping, percent lubrication coverage of the sheet metal blank, thickness of a lubrication layer applied to the sheet metal blank before stamping, and springback of the sheet metal blank after one or more forming steps, among others. And the mechanical properties (e.g., yield strength, ultimate tensile strength, ductility, among others) and geometric dimensions (e.g., thickness) can vary from sheet metal blank to sheet metal blank, and can vary from one lot of sheet metal blanks to another lot of sheet metal blanks. Accordingly, developing a robust stamping system and process for assembly line manufacturing of complex components such as the hood panel 5 with reduced errors and reduced scrap is an engineering challenge.

Figure 2:
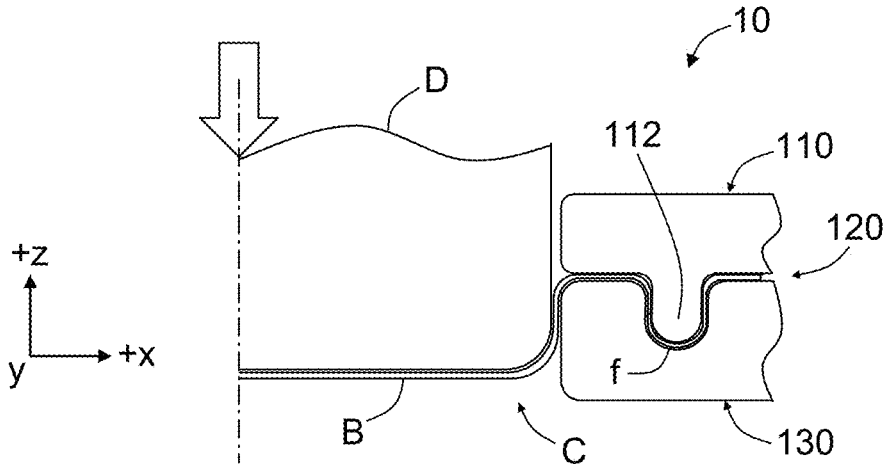
FIG. 2 is a side cross-sectional view (without cross-hatching) of a forming die with a bead according to the teachings of the prior art.

With reference to FIG. 2, one example of a traditional forming die 10 with a first die component 110 having a male bead 112 and a second die component 130 having a female bead 132 is shown. The male bead 112 and the female bead 132 form a bead 120. When the first die component 110 is spaced apart (z direction) from the second die component 130 the sheet metal blank B is positioned between the first and second die component 110, 130 (e.g., on the second die component 130) such that the blank B extends across a forming cavity 'C'. And when the blank B is in a desired position the first die component 110 is moved downwardly (−z direction) and into contact with the blank B such that a flange or bead section of the blank B is positioned and held between the first die component 110 and the second die component 130 as shown in FIG. 1. Particularly, a portion of the blank B is positioned between the male bead 112 and the female bead 132. Then, a punch die D is moved into the forming cavity such the blank B is formed into forming cavity C.

During forming of the blank B into the forming cavity C, the blank B extending beyond (+x direction) the bead 120 is pulled (−x direction) into the female bead 132, pulled or bent around the male bead 112, and then re-straightened upon exiting the female bead 132. It should be understood that bending of the blank B around the male bead 112 and straightening of the blank B as it exits the female bead 132 (−x direction) provides a restraining force to enhance panel stretch during the forming operation. However, and as noted above, traditional forming dies with a single bead may not provide sufficient restraining force during a forming operation depending on factors such as the material of the blank B, properties of the material from which the blank B is made from, a thickness of the blank B, and a lubricant used during the forming operation, among others. Accordingly, some traditional forming dies use "double beads" (i.e., two beads next to each other) to provide desired restraining forces. However, the use of such double beads requires additional blank material, i.e., additional flange section material, during the forming operation, thereby increasing the cost of manufacture.

Figure 3:
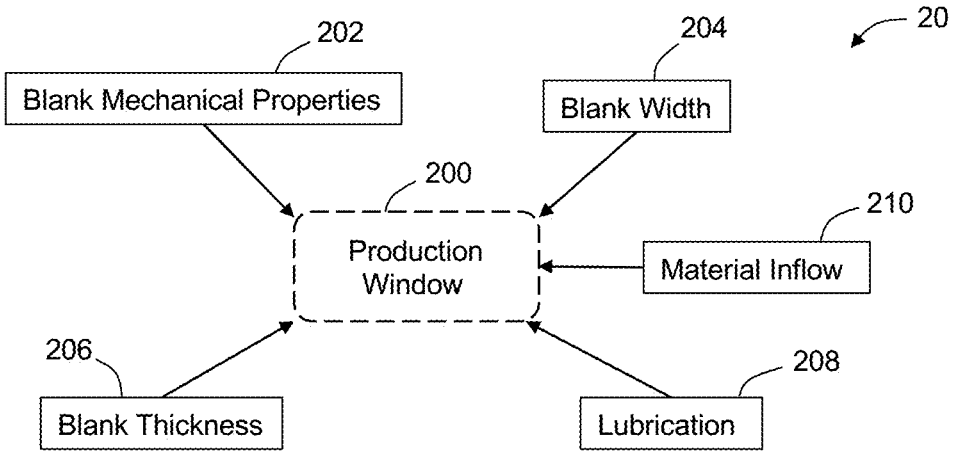
FIG. 3 is diagram showing factors and parameters that affect or define a production window according to the teachings of the present disclosure.

Referring to FIG. 3, a diagram 20 of the various factors and parameter that affect or define a production window 200 (also known as a "drawing window", "stamping window", or "press window") is shown. As used herein, the phrase "production window" refers to a range of predefined stamping parameters that result in a desired stamped part. In addition, when one or more of the predefined stamping parameters falls outside the range, an undesirable stamped part is formed with examples of an undesirable stamped part including a stamped part with wrinkles or wrinkling, a stamped part with an undesirable surface finish (e.g., an orange peel surface finish), a stamped part with an undesirable amount springback, and a stamped part with a crack or fracture, among others.

In some variations, the production window 200 is defined by one or more mechanical properties 202 of a blank B to be stamped, a width 204 of the blank B to be stamped, a thickness 206 of the blank B to be stamped, the amount, type, coverage area and/or thickness of lubrication 208 applied to the blank B to be stamped, and/or the material inflow 210 of the blank B during stamping of the blank B. In addition, the amount, type, coverage area and/or thickness of lubrication 208 applied to the blank B can affect the local coefficient of friction between a particular location or area on the blank B and a corresponding location on a forming die that comes into contact with and forms the particular location or area of the blank B, and thereby affect the defined production window 200. It should be understood that the material inflow, i.e., the amount of material inflow, is inversely proportional to the restraining force provided by a male/female bead during stamping of a blank. That is, the greater the restraining force provided by a male/female bead, the less material inflow that occurs during stamping of a blank. For example, no material inflow corresponds to a 100% restraining force and an unrestricted material inflow corresponds to a 0% restraining force.

Figure 4A:
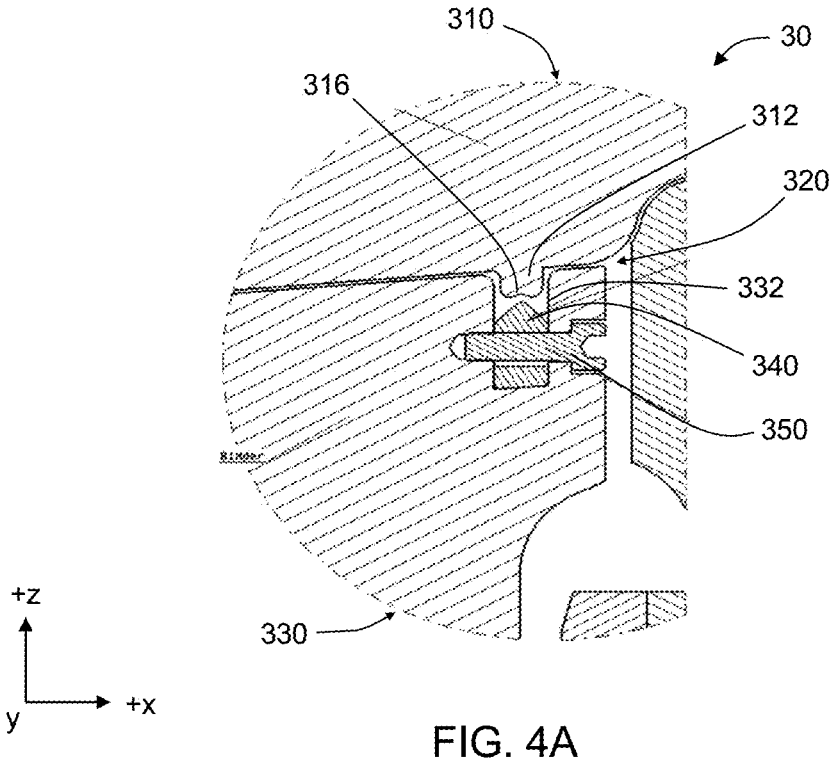
FIG. 4A is a side cross-sectional view of a forming die with a protrusion in a first position according to one form of the present disclosure.
Figure 4B:
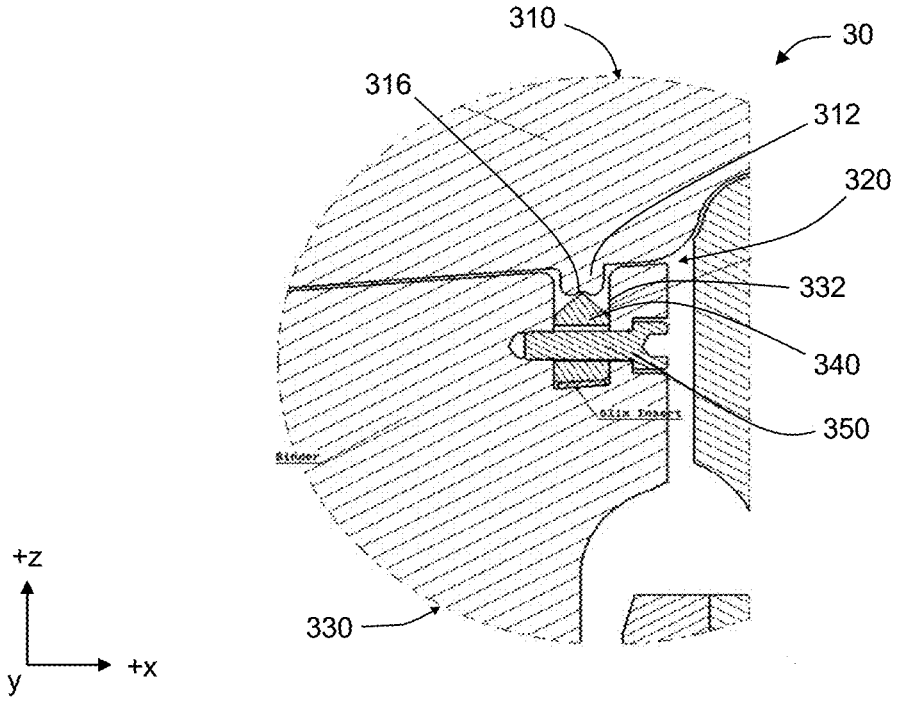
FIG. 4B is a side cross-sectional view of the forming die in FIG. 4A with the protrusion in a second position.
Figure 4C:
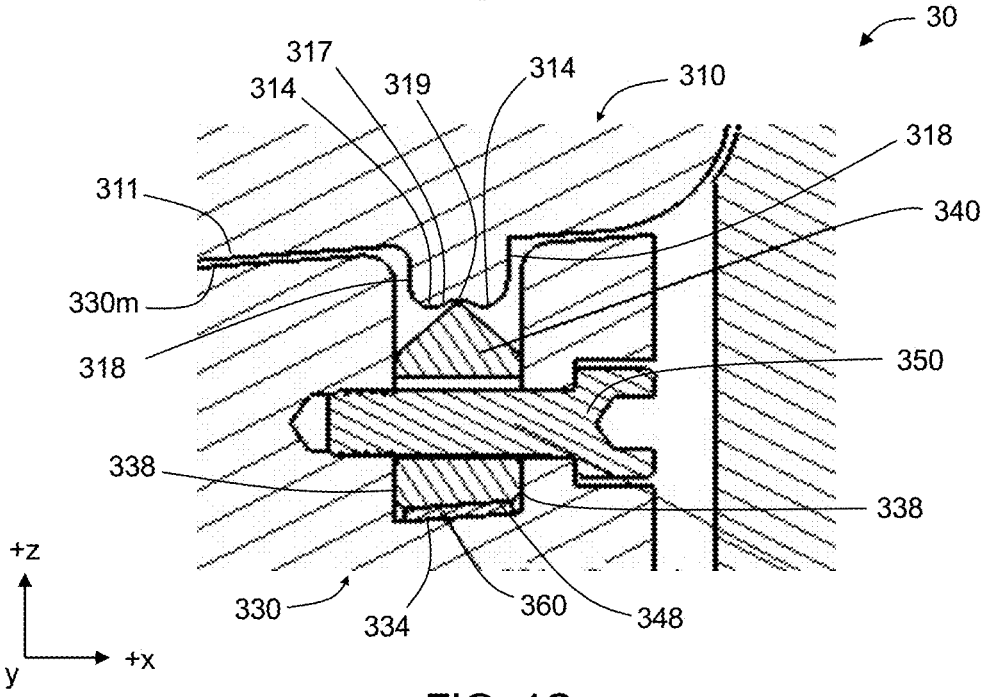
FIG. 4C is an enlarged view of section '4C' in FIG. 4B.

Referring now to FIGS. 4A-4C, a forming die 30 according to one form of the present disclosure is shown. The forming die 30 includes a bead 320 with a protrusion 340. The bead 320 with the protrusion 340 in a first position is shown in FIG. 4A and the bead 320 with the protrusion 340 in a second position is shown in FIG. 4B. The forming die 30 with the bead 320 includes a first die component 310 with a male bead 312 and a second die component 330 with a female bead 332. The male bead 312 has a groove 316 and the female bead 332 has the protrusion 340. In some variations the protrusion 340 is complimentary with the groove 316 such that the protrusion 340 is aligned (x direction) with the groove 316 when the male bead 312 extends into the female bead 332 as shown in FIGS. 4A and 4B. In some variations the second die component 330 includes a fastening element 350 configured to extend transversely (x direction) through and secure the protrusion 340 to the second die component 330 as discussed further below.

Referring particularly to FIG. 4C, in at least one variation, the male bead 312 includes a push surface 314 and a pair of male bead sidewalls 318 (also referred to herein simply as "a pair of sidewalls 318" or "sidewalls 318") extending from the push surface 314 to a main surface 311 of the first die component 310. Also, the groove 316 extends inwardly (+z direction) into the male bead 312. In some variations, the groove 316 is defined by at least one groove sidewall 317 and a groove root 319 as shown in FIGS. 4A and 4B.

In some variations, the female bead 332 includes a pair of female bead sidewalls 338 (also referred to herein simply as "a pair of sidewalls 338" or "sidewalls 338") extending from a lower surface 334 to a main surface 330*m* of the second die component 330. Also the protrusion 340 extends upwardly (+z direction) from the lower surface 334 into the female bead 332.

As noted above, in FIG. 4A the protrusion 340 is shown in the first position and in FIGS. 4B-4C the protrusion 340 is shown in the second position. Particularly, the protrusion 340 in FIG. 4A is in a lower (−z direction) position and the protrusion 340 in FIGS. 4B-4C is in an upper (+z direction) position. And as shown in FIGS. 4B-4C, the protrusion 340 in the upper position is provided by an insert 360 positioned between the lower surface 334 of the female bead and a lower surface 348 of the protrusion 340. It should be understood that the protrusion 340 in the first position (FIG. 4A) provides for or is configured for increased material inflow of a blank B being stamped compared to the protrusion 340 in the second position. Stated differently, the protrusion 340 in the first position provides more distance between the protrusion 340 and the male bead 312, and thus less restraining force, compared to the protrusion 340 in the second position. Accordingly, the teachings of the present disclosure provide for adjustment of the protrusion 340 within the female bead 332 such that the restraining force on blank material flowing into and out of the bead 320 is adjusted. For example, inserts 360 with different thicknesses (z direction) are used to vary the distance between the protrusion 340 and the male bead 312, and thereby vary the restraining force on blanks B being stamped and having generally the same thickness. In the alternative, inserts 360 with different thicknesses (z direction) are used to vary the distance between the protrusion 340 and the male bead 312, and thus apply a generally constant restraining force on blanks B being stamped and have different thicknesses.

Figure 5:
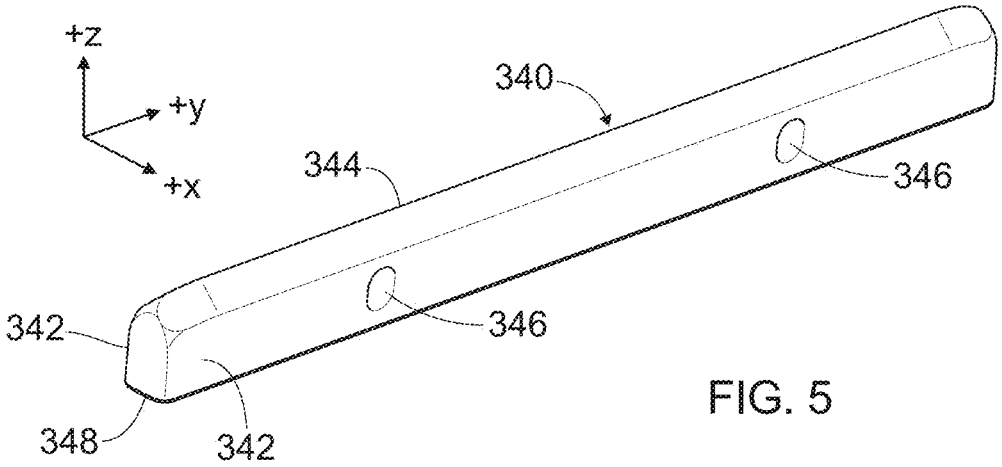
FIG. 5 is a perspective isolated view of the protrusion in FIGS. 4A-4C.

Referring to FIG. 5, an isolated view of the protrusion 340 is shown. In at least one variation, the protrusion 340 is defined by at least one protrusion sidewall 342 and a protrusion crown 344. The protrusion 340 has a length (y direction), width (x direction) and a height (z direction) from a lower surface 348 to the protrusion crown 344, and in some variations the protrusion has a pair of sidewalls extending from the lower surface to the protrusion crown 344 as shown in FIG. 5. And in at least one variation the protrusion 340 includes at least one slot 346. In some variations the at least one slot 346 has a height (z direction) greater than a length (y direction) and the protrusion is configured to slide up and down (+/− z direction) within the female bead 332 as discussed in greater detail below. It should be understood that the width of the protrusion is dimensioned such that the protrusion fits or slides within the female bead 332. It should also be understood that while the protrusion 340 shown in FIG. 5 is generally linear, that protrusions of different shapes and included within the teachings of the present disclosure.

Figure 6:
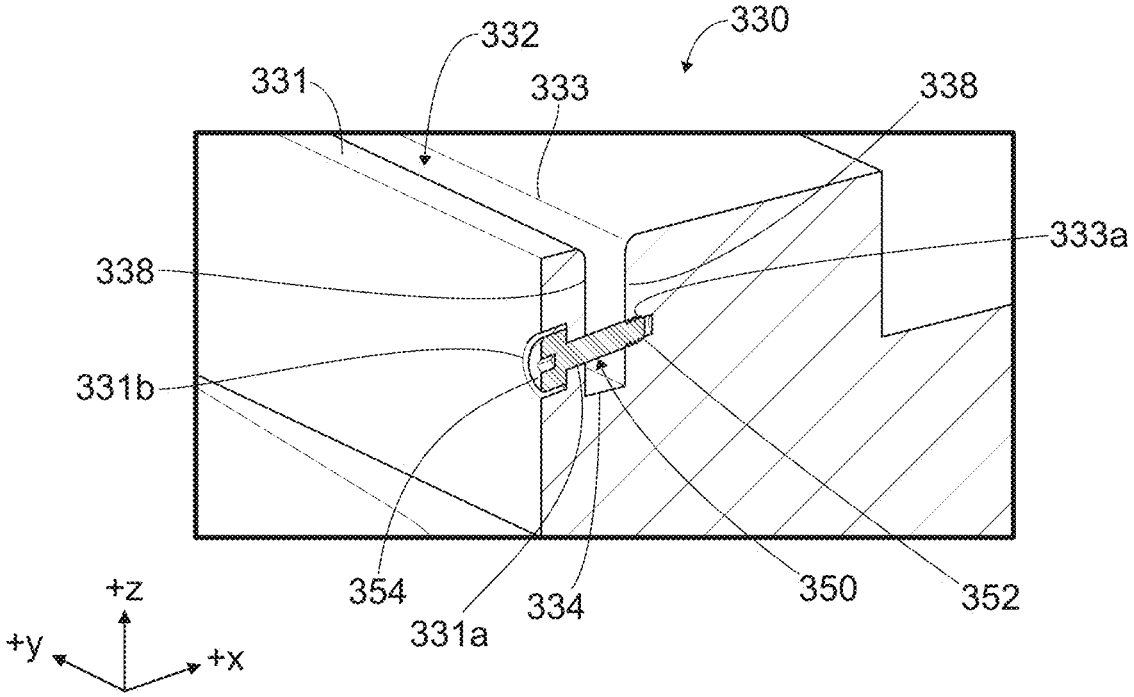
FIG. 6 is a sectional view of a die component with a female bead according to the teachings of the present disclosure.

Referring to FIG. 6, the second die component 330 with the female bead 332, the fastening element 350, and without the protrusion 340 (for clarity) is shown. The fastening element 350 extends through a first portion 331 that defines one of the sidewalls 338 and into a second portion 333 that defines another of the sidewalls 338 (FIG. 4C). In some variations, and as shown in FIG. 6, the fastening element 350 is a threaded fastening element 350 with a threaded end 352 and a head end 354. In such variations, the first portion 331 can have an aperture 331*a* with a head inset portion 331*b* configured for the threaded fastening element 350 to slide through and the head end 354 to be disposed and/or seated in the head inset portion 331*b*. And the second portion 333 includes a threaded aperture 333*a* configured to threadingly engage with the threaded end 352. Accordingly, the protrusion 340 is slidably and securely attached within the female bead 332 with the fastening element 350 extending through the at least one slot 346 as shown in FIGS. 4A-4C and threadingly engaged with the second portion 333 of the second die component 330 as shown in FIG. 6. Stated differently, the protrusion 340 is slidably and securely attached within the female bead 332 such that the position of the protrusion 340 within the female bead is adjustable with an insert as shown in FIGS. 4A-4C or via other devices and/or equipment as discussed below.

Figure 7A:
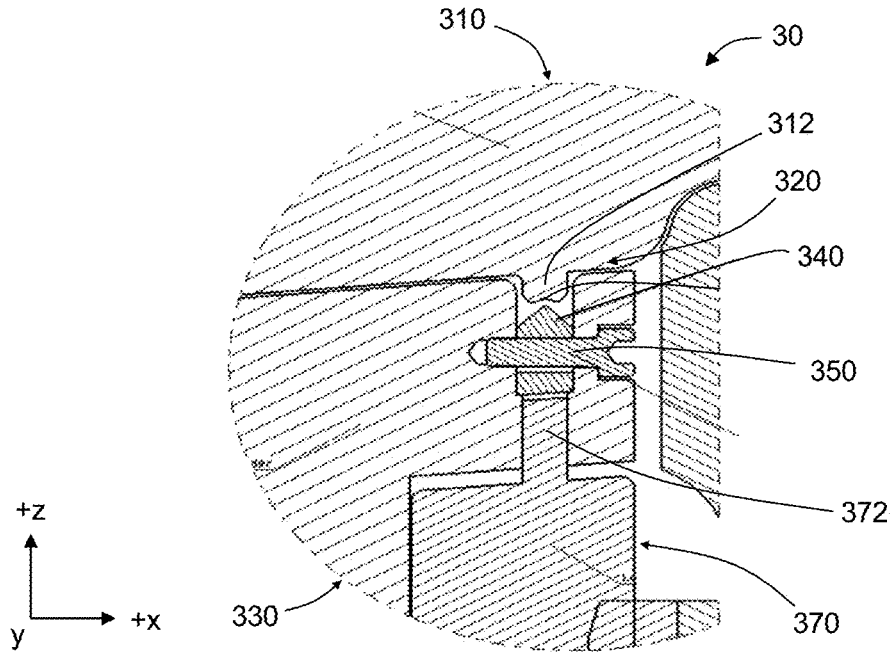
FIG. 7A is a side cross-sectional view of a forming die with a protrusion in a first position according to another form of the present disclosure.
Figure 7B:
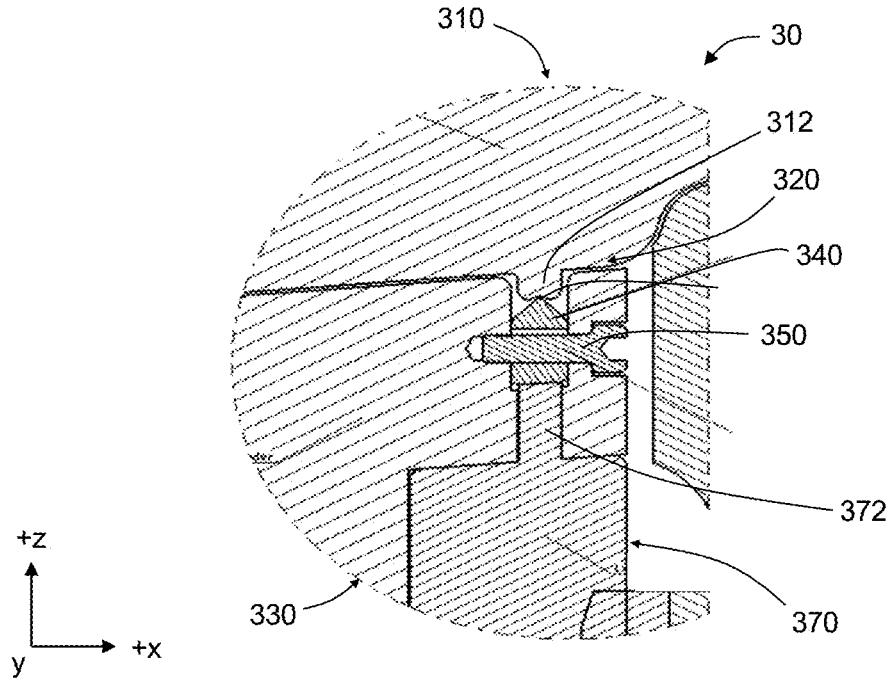
FIG. 7B is a side cross-sectional view of the forming die in FIG. 7A with the protrusion in a second position.

Referring now to FIGS. 7A-7B, the forming die 30 according to another form of the present disclosure is shown. The forming die 30 includes the bead 320 having a reverse bead geometry, i.e., the female bead 332 with the protrusion 340. The bead 330 with the protrusion 340 in the first position is shown in FIG. 7A and the bead 320 with the protrusion 340 in the second position is shown in FIG. 7B. However, and unlike the forming die 30 according to the form shown in FIGS. 4A-4C, the forming die 30 in FIGS. 7A-7B includes an actuator 370 configured to move the protrusion 340 between the first position and the second position. It should be understood that the actuator 370 can be any type of actuator configured to move the protrusion within the female bead 332 such as a hydraulic actuator, a pneumatic actuator, a mechanically drive actuator among others. It should also be understood that the actuator 370 is configured to move the protrusion 340 between the first position and the second position between stamping of blanks B and/or during stamping of a respective blank B as described in greater detail below. Stated differently, the actuator 370 is configured to move the protrusion 340 in real-time and thereby adjust a restraining force during forming of a blank B.

Figure 8:
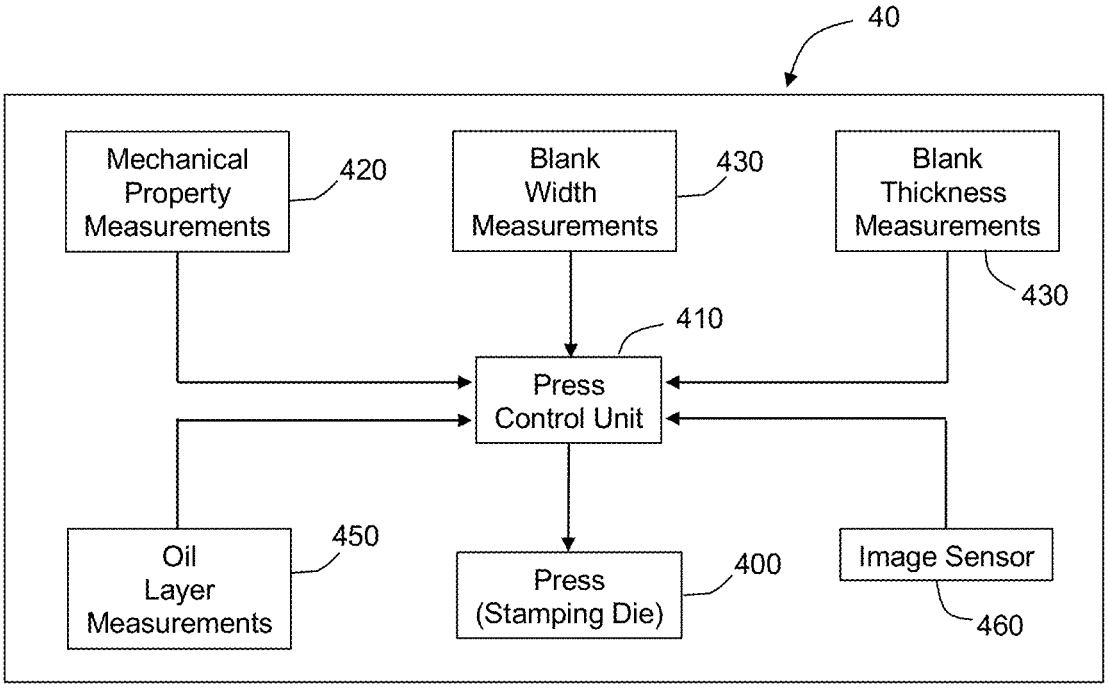
FIG. 8 is a block diagram of press system according to the teachings of the present disclosure.

Referring now to FIG. 8, a block diagram for a system 40 for stamping blanks B. In some variations the system 40 is a sheet metal stamping press line 40 that includes a stamping press 400 with a stamping press control unit 410 and a forming die e.g., a forming die according to the teachings of the present disclosure. In at least one variation the system 40 includes at least one of a mechanical property measurement module 420, a blank width measurement module 430 (e.g., with a blank width measurement detector), a blank thickness measurement module 440 (e.g., with a blank thickness measurement detector), a lubrication measurement module 450 (e.g., with a lubrication measurement detector), and an image sensor module 460. In some variations the system 40 includes two or more of the at least one of a mechanical property measurement module 420, blank width measurement module 430, blank thickness measurement module 440, lubrication measurement module 450, and image sensor module 460. For example, in some variations the system 40 includes three or more of the at least one of a mechanical property measurement module 420, blank width measurement module 430, blank thickness measurement module 440, lubrication measurement module 450, and image sensor module 460. And in at least one variation the system 40 includes the at least one of a mechanical property measurement module 420, blank width measurement module 430, blank thickness measurement module 440, lubrication measurement module 450, and the image sensor module 460.

The mechanical property measurement module 420, blank width measurement module 430, blank thickness measurement module 440, lubrication measurement module 450, and/or image sensor module 460 are in communication with the stamping press control unit 410 and the stamping press control unit 410 is configured to control operation of the stamping press 400. For example, in some variations the stamping press control unit 410 is configured to control cushion tonnage (also known as "draw cushion") and speed parameters (e.g., stamping speed) of the stamping press 400.

In some variations the stamping press control unit 410 is configured to control the actuator 370 such that the position of the protrusion 340 is adjustably controlled during a blank stamping campaign or run. In such variations, it should be understood that the stamping press control unit is configured to control material inflow material inflow of a blank B being stamped with the stamping press 400.

The mechanical property measurement module 420 can include one or more mechanical property measurement machines (e.g., a tensile testing machine) that measures one or more mechanical properties (e.g., hardness, tensile strength, yield strength, ductility, among others) of a blank B and/or a sheet of material used to form a plurality of blanks B. In some variations the one or more mechanical property measurement machines transmit mechanical property testing data to the stamping press control unit 410. In the alternative, or in addition to, mechanical property testing data is manually entered using a control unit input interface (e.g., a keyboard) in communication with the stamping press control unit 410.

The blank width measurement module 430 includes one or more sensors configured to measure the width of blanks B to be stamped with the stamping press 400. In some variations the one or more sensors transmit measured width data to the stamping press control unit 410. Also, the blank thickness measurement module 440 includes one or more sensors configured to measure the thickness of blanks B to be stamped with the stamping press 400. In some variations the one or more sensors transmit measured thickness data to the stamping press control unit 410.

The lubrication measurement module 450 includes one or more sensors configured to measure percent coverage, areas or location of coverage, and/or a thickness of a lubrication layer applied to a surface of a blank B to be stamped with the stamping press 400. In some variations the one or more sensors transmit measured percent coverage, areas or location of coverage, and/or thickness of a lubrication layer thickness data to the stamping press control unit 410.

The image sensor module 460 includes one or more image sensors configured to capture one or more images of a blank B that has been stamped by the stamping press 400. Non-limiting examples of image sensors include charge-coupled device (CCD) sensors, active-pixel (CMOS or NMOS) sensors, lidar sensors, among others. In some variations the image sensor module 460 includes one or more controllers configured to compare the one or more captured images with an FEA analysis of the stamped blank. And in some variations the image sensor module 460 transmits comparisons of the one or more captured images with the FEA analysis of the stamped blank to the stamping press control unit 410. Stated differently, in at least one variation the image sensor module 460 provides a comparison between an FEA analysis or simulation of a stamped blank B and an actual shape of a stamped blank B to the stamping press control unit 410.

In operation, one or more samples of sheet metal material are tested at the mechanical property measurement module 420 and at least a portion of the resulting mechanical property testing data is transmitted to the stamping press control unit 410. It should be understood that the mechanical property measurement module 420 can be a testing station or testing module on the same stamping line as the stamping press 400, or in the alternative, the mechanical property measurement module 420 can be a testing station or testing module that is not on the same stamping line as the stamping press 400, e.g., at a different location or facility where mechanical property testing is performed.

In some variations, blanks B are tested at the mechanical property measurement module 420. In other variations, a sheet of the sheet metal material from which blanks B are to be formed (e.g., from a coil of the sheet metal material) is tested at the mechanical property measurement module 420, and in such variations blanks B are formed (e.g., cut) from the sheet of sheet metal material.

In some variations, blanks B of the sheet metal material with a width and a length within a predefined tolerance are subjected to a width measurement at the blank width measurement module 430 and/or a thickness measurement at the blank thickness measurement module 440. In such variations an actual (measured) width and/or an actual (measured) thickness of each blank B to be stamped with the stamping press 400 is determined and transmitted to the stamping press control unit 410.

Figure 9A:
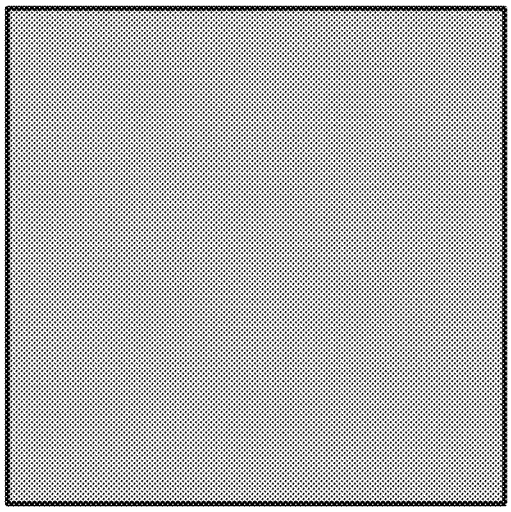
FIG. 9A is a scan of a surface of a sheet metal blank with a desired lubrication layer applied to the surface.
Figure 9B:
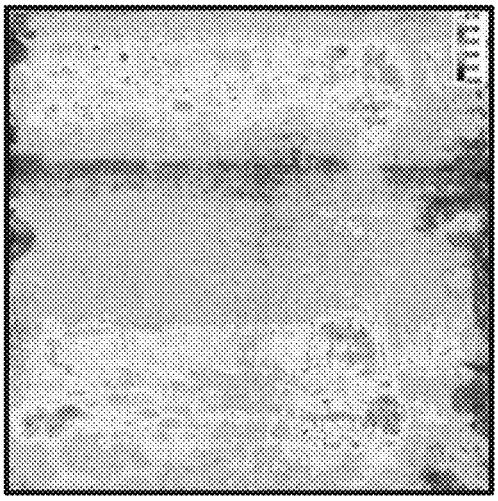
FIG. 9B is a scan of a surface of a sheet metal blank with an actual lubrication layer applied to the surface.
Figure 9B:
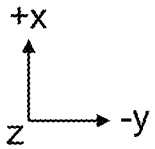
Figure 9C:
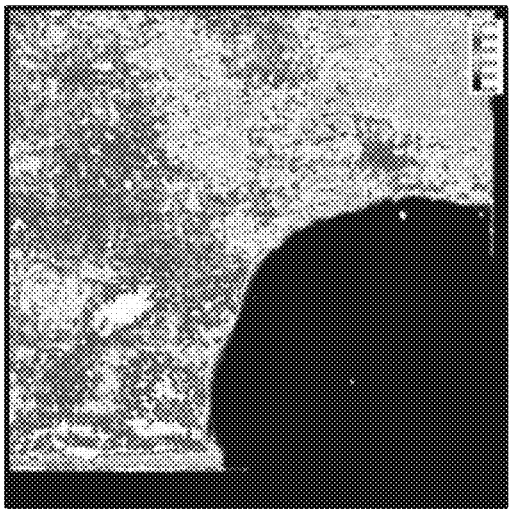
FIG. 9C is a scan of a surface of a sheet metal blank with another actual lubrication layer applied to the surface.

In at least one variation the blanks B are lubricated in preparation for stamping and in such variations the percent coverage, areas or locations of coverage, and/or a thickness of a lubrication layer applied to a surface of the blanks B is measured at the lubrication measurement module 450 and the lubrication measurement data is transmitted to the stamping press control unit 410. For example, and with reference to FIG. 9A-9C, FIG. 9A represents a desired coverage of a lubrication layer applied to a surface of a blank B, and FIGS. 9B and 9C show actual coverage of lubrication layer applied to surfaces of two blanks B. As shown in FIGS. 9B and 9C, less than desired coverage of the surfaces of the blanks B has been applied. In addition, in some variations the lubrication measurement module 450 calculates a percent coverage of the lubrication layer applied to the surfaces of the blanks B. In the alternative, or in addition to, the stamping press control unit 410 calculates a percent coverage of the lubrication layer applied to the surfaces of the blanks B.

In some variations, the image sensor module 460 includes a camera (e.g., an AI camera) with one or more images sensors that detects and measures predefined features of one or more of the stamped blanks B and compares the measured features with one or more FEA simulations of the stamped blank B. Stated differently, the image sensor module 460 compares the actual stamped blank B to a model or simulation of the stamped blank B and provides the comparison to the stamping press control unit 410. As used herein, the phrase "AI camera" refers to a camera configured to execute computational photography to learn and identify wrinkles, undesirable surface finishes, springback, and cracks or fractures, among others, of a stamped part. In some variations, the image sensor module 460 measures the amount of material inflow and/or springback for one or more of the stamped blanks B, compares the measured material inflow and/or springback to an FEA simulation of the material inflow and/or springback, and transmits the comparison to the stamping press control unit 410. In other variations, the image sensor module 460 simply measures the amount of material inflow and/or springback for one or more of the stamped blanks B and transmits the material inflow measurement data to the stamping press control unit 410. Accordingly, the image sensor module 460 is configured to detect, measure, quantify, and/or qualify quality-related features of the stamped blank B such as fracture, surface quality, skid marks, and panel shape. In some variations, the image sensor module 460 is configured to rebuild the 3D geometry and material inflow of a stamped panel. And in at least one variation the image sensor module 460 is configured to perform or calculate a draw analysis of a stamped panel via a comparison of an FEA prediction of the stamped panel with the rebuilt 3D geometry and material inflow of the stamped panel.

The stamping press control unit 410 receives the data from the mechanical property measurement module 420, the blank width measurement module 430, the blank thickness measurement module 440, the lubrication measurement module 450, and/or the FEA versus actual draw analysis module 460, and in some variations generates an engineered process window (referred to hereafter a "process window") for stamping subsequent blanks B. In some variations, data from the mechanical property measurement module 420, the blank width measurement module 430, the blank thickness measurement module 440, the lubrication measurement module 450, and/or the image sensor module 460 for a plurality of blank stampings or plurality of blank stamping campaigns are used to determine a current process window. In addition, the stamping press control unit 410 uses the current process window to control in real-time the stamping process to ensure a blank B is not deformed outside of the current process window.

For example, in some variations, the stamping press control unit 410 controls cushion tonnage, stamping press speed, and/or position of the protrusion 340 in real-time as a function of the current engineered process window.

Figure 10:
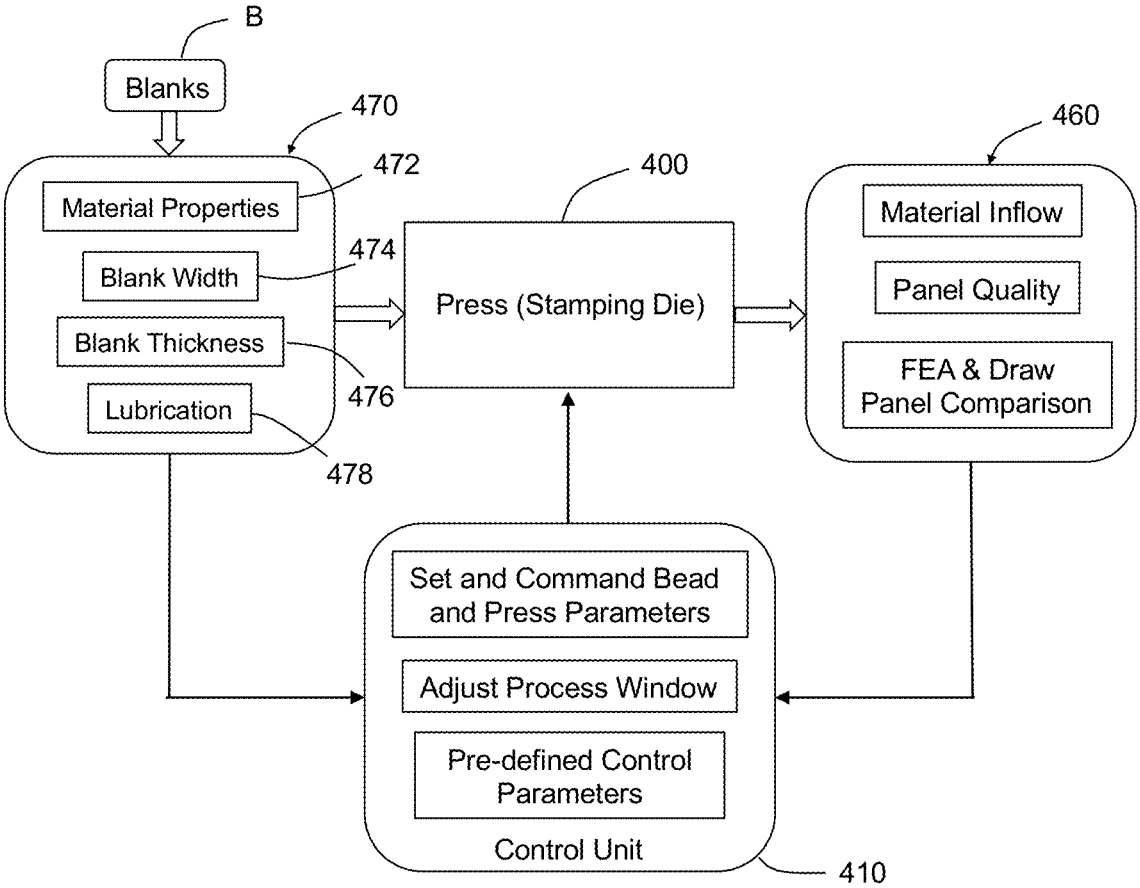
FIG. 10 is a flow chart showing the flow of blanks and data for the press system in FIG. 8.

For example, and with reference to FIG. 10, blanks B pass through the mechanical property measurement module 420, the blank width measurement module 430, the blank thickness measurement module 440, and the lubrication measurement module 450 such that input 470 in the form of material properties 472, blank width 474, blank thickness 474, and lubrication thickness and/or coverage 476 is provided to the stamping press control unit 410. It should be understood that mechanical property data, blank width data, blank thickness data, and/or lubrication data on each of the blanks B or a subset of the blanks can be provided to the stamping press control unit 410.

Still referring to FIG. 10, the stamping press control unit 410 includes predefined control parameters 412 for the stamping press 400 and is configured to adjust a process window 414 as a function of the input 470. In addition, the stamping press control unit 410 sets or determines desired bead and press parameters for the stamping press 400 as a function of the input 470 and/or the adjusted process window 414 for one or more of the blanks B and commands the press 400 to execute the desired bead and press parameters to during pressing of the banks B.

The blanks B proceed to the press 400 and are formed into a part. In addition, the image sensor module 460 captures one or more images of the blanks B before, during and/or after being formed by the press 400. In some variations the image sensor module 460 measures the amount of material inflow during stamping of the blanks B, determines a panel quality of the stamped blanks, and/or executes an FEA and draw panel comparison for the stamped blanks, and provides such output to the stamping press control unit 410. In addition, the stamping press control unit 410 is configured to adjust the process window 412 and/or set and command bead and press parameters as a function of the output provided by the image sensor module 460.

Figure 11A:
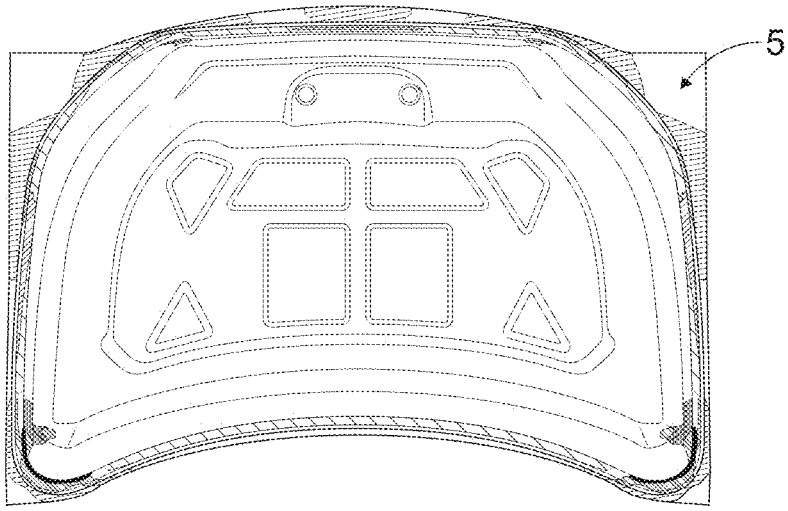
FIG. 11A is an FEA image of a plan view of the hood panel in FIG. 1 formed with a set of predefined stamping press control parameters and a coefficient of friction equal to 0.11.
Figure 11B:
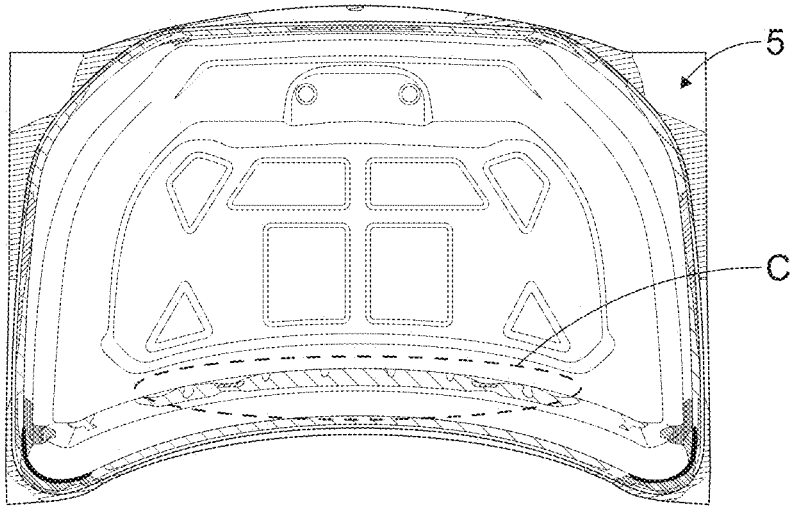
FIG. 11B is an FEA image of a plan view of the hood panel in FIG. 1 formed with a set of predefined stamping press control parameters and a coefficient of friction equal to 0.17.
Figure 11C:
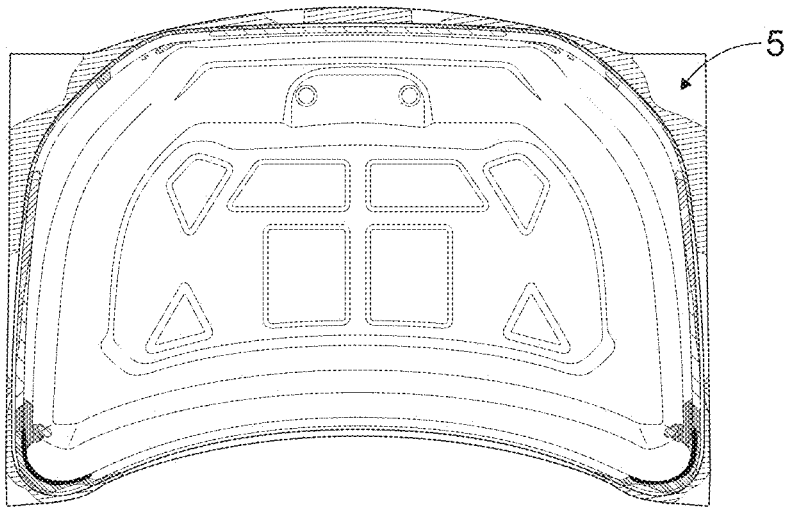
FIG. 11C is an FEA image of a plan view of the hood panel in FIG. 1 formed with a set of adjusted stamping press control parameters according to the teachings of the present disclosure and a coefficient of friction equal to 0.17.

Referring now to FIGS. 11A-11C, an example of the hood panel 5 formed according to the teachings of the present disclosure is shown. Particularly, FIG. 11A shows an FEA image of the hood panel 15 formed with a set of predefined control parameters and a coefficient of friction equal to 0.11 between the blank B and the forming die 30, FIG. 11B shows an FEA image of the hood panel 5 formed with the same set of predefined control parameters and a coefficient of friction equal to 0.17 between the blank B and the forming die 30, and FIG. 11C shows an FEA image of the hood panel 5 formed with adjusted set of control parameters and a coefficient of friction equal to 0.17 between the blank B and the forming die 30. As shown by the circled region 'C' in FIG. 11B, a failure (e.g., cracking) has occurred during forming of the hood panel 5 when a greater coefficient of friction is present (e.g., due to less than desired lubrication coverage) between the blank B and the forming die 30 during the forming process. However, adjustment of the stamping press control parameters (e.g., cushion tonnage, stamping speed and/or reverse bead position) enhances the restraining force on the blank such that a desired hood panel 5 is formed as shown in FIG. 11C.

Figure 12A:
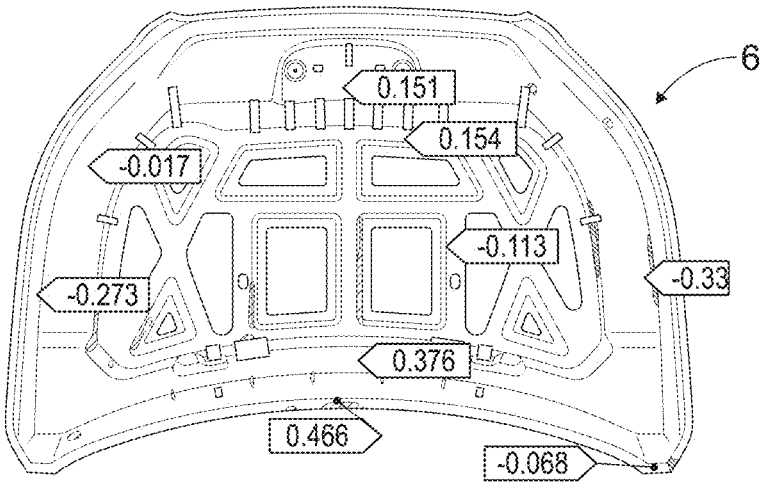
FIG. 12A is an FEA image of a plan view of another hood panel formed with a set of predefined stamping press control parameters and a coefficient of friction equal to 0.11.
Figure 12B:
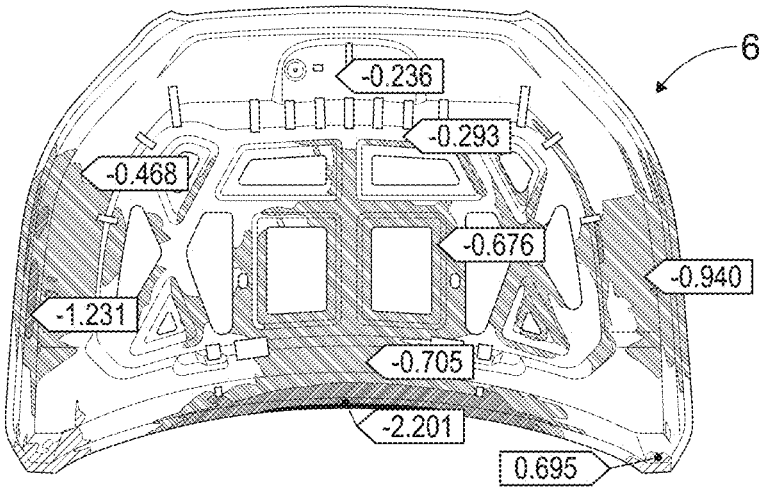
FIG. 12B is an FEA image of a plan view of another hood panel formed with a set of predefined stamping press control parameters and a coefficient of friction equal to 0.17.
Figure 12C:
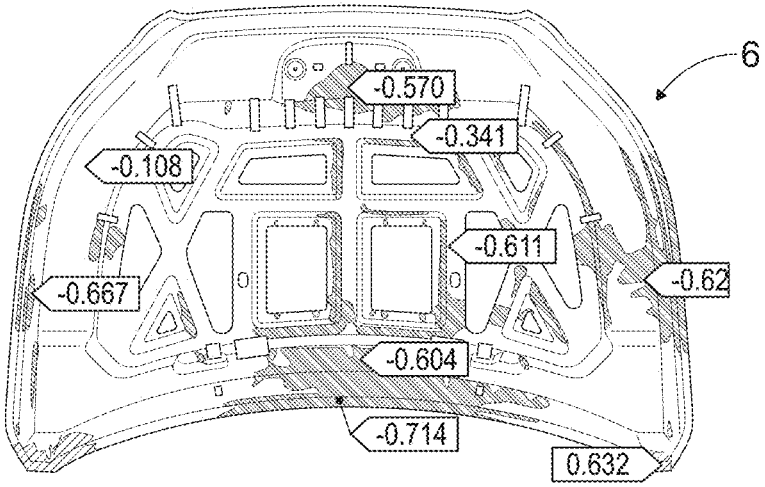
FIG. 12C is an FEA image of a plan view of another hood panel formed with a set of adjusted stamping press control parameters according to the teachings of the present disclosure and a coefficient of friction equal to 0.17.

Referring to FIGS. 12A-12C, another example of a hood panel 6 formed according to the teachings of the present disclosure is shown. Particularly, FIG. 12A shows an FEA image with springback values (in millimeters) at various locations on the hood panel 6 and formed with a set of predefined control parameters and a coefficient of friction equal to 0.11 between the blank B and the forming die 30, FIG. 12B shows an FEA image with springback values of the hood panel 5 formed with the same set of predefined control parameters and a coefficient of friction equal to 0.17 between the blank B and the forming die 30, and FIG. 11C shows an FEA image with springback values of the hood panel 5 formed with adjusted set of control parameters and a coefficient of friction equal to 0.17 between the blank B and the forming die 30. As shown in FIG. 12B, springback variations of about 2.5 mm are present when a greater coefficient of friction is present (e.g., due to less than desired lubrication coverage) between the blank B and the forming die 30 during the forming process. However, adjustment of the stamping press control parameters (e.g., cushion tonnage, stamping speed and/or reverse bead position) enhances the restraining force on the blank such that springback variations are reduced to about 1 mm as shown in FIG. 12C.

Accordingly, the present disclosure provides a forming die with a reverse bead geometry, a stamping machine (e.g., a stamping press) with the forming die, and a system for stamping blanks that provides for real-time adjustment of the stamping process. For example, real-time adjustment of the material inflow between or during stamping of a plurality of blanks inhibits quality control of the stamping process. And such a system allows for real-time feedback related to the mechanical properties of the blanks, geometric properties of the blanks, lubrication applied to the blanks, and/or forming results versus FEA simulation of the blanks to be used to adjust lubrication and/or stamping press parameters during a stamping campaign such that enhance quality of stamped blanks and reduced scrap is provided.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C." Also, the terms "upper" and "lower" are used with reference to the drawings for explanation purposes and not as a limitation to the teachings of the present disclosure.

In this application, the term "controller" "control unit", and/or "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group)

that executes code; a memory circuit (shared, dedicated, or group) that stores code executed by the processor circuit; other suitable hardware components (e.g., op amp circuit integrator as part of the heat flux data module) that provide the described functionality; or a combination of some or all of the above, such as in a system-on-chip.

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A forming die comprising:

a first die component with a male bead and a second die component with a female bead, the female bead defining a recess for receiving the male bead therein, wherein the male bead and the female bead form a bead with a reverse bead geometry with the male bead comprising a groove and the female bead comprising a protrusion complimentary with the groove such that the protrusion is aligned with the groove when the male bead is moved toward the female bead in a direction parallel to a height direction of the female bead and extends into the female bead, and the protrusion is removably attached to the female bead and removably disposed within the recess of the female bead to be closer or away from the groove of the male bead along the height direction of the female bead to change a height of the protrusion from a bottom surface of the recess of the female bead.

2. The forming die according to claim 1, further comprising an attachment member, the protrusion defining at least one slot, the attachment member extending at least partially into the at least one slot of the protrusion to removably secure the protrusion to the female bead.

3. The forming die according to claim 2, wherein the at least one slot extends in a transverse direction through the protrusion and the attachment member extends normal to a height direction of the protrusion.

4. The forming die according to claim 3, wherein the second die component comprises a first aperture on one side of the female bead and a second aperture co-axial with the first aperture on another side of the female bead.

5. The forming die according to claim 4, wherein the attachment member extends through the first aperture of the second die component, through the at least one slot of the protrusion, and is mechanically engaged with the second aperture on the another side of the female bead.

6. The forming die according to claim 4, wherein the attachment member is a threaded fastener, the second aperture is a threaded hole, and the threaded fastener extends through the first aperture of the second die component, through the at least one slot of the protrusion, and is threadingly engaged with the threaded hole on the another side of the female bead.

7. The forming die according to claim 1, wherein a gap is defined between the groove of the male bead and the protrusion of the female bead when the male bead extends into the female bead, and wherein the protrusion has a first position within the female bead to increase a size of the gap and a second position within the female bead to reduce the size of the gap.

8. The forming die according to claim 1 further comprising a stamping machine with the first die component and the second die component, and a control unit configured to receive data on a blank to be stamped with the stamping machine, wherein the data is at least one of mechanical property measurement data on the blank to be stamped, width measurement data on the blank to be stamped, thickness measurement data on the blank to be stamped, lubrication measurement data for lubrication on the blank to be stamped, or finite element analysis (FEA) versus actual draw comparison data on the blank to be stamped.

9. The forming die according to claim 8, wherein the control unit is configured to adjust at least one of a cushion tonnage and a stamping speed of the stamping machine as a function of the received data.

10. The forming die according to claim 8, wherein the control unit is configured to adjust a position of the protrusion as a function of the received data.

11. The forming die according to claim 8, wherein the control unit is configured to adjust at least one of a cushion tonnage of the stamping machine, a stamping speed of the stamping machine, and a position of the protrusion as a function of the received data.

12. The forming die according to claim 8, wherein the control unit is configured to adjust a position of the protrusion between a first position within the female bead configured for an increased amount of material located between the male bead and the female bead within a predefined production window and a second position within the female bead configured for a reduced amount of the material located between the male bead and the female bead within the predefined production window.

13. A sheet metal stamping press line comprising:

a blank width measurement detector;

a blank thickness measurement detector;

a lubrication measurement detector; and a stamping press machine configured to stamp press a plurality of sheet blanks, the stamping press machine comprising:

a first die component with a male bead and a second die component with a female bead, the female bead defining a recess for receiving the male bead therein, wherein the male bead and the female bead form a bead with a reverse bead geometry with the male bead comprising a groove and the female bead comprising a protrusion removably attached to the female bead and removably disposed within the recess of the female bead and complimentary with the groove such that the protrusion is aligned with the groove when the male bead is moved toward the female bead in a direction parallel to a height direction of the female bead and extends into the female bead and such that a height of the protrusion from a bottom surface of the recess is adjustable to make the protrusion of the female bead closer or away from the groove of the male bead; and a control unit configured to adjust at least one of a cushion tonnage of the sheet metal stamping press machine, a stamping speed of the sheet metal stamping press machine, and a position of the protrusion.

14. The sheet metal stamping press line according to claim 13, wherein the blank width measurement detector is configured to transmit width data on a blank to be stamped, the blank thickness measurement detector is configured to transmit thickness data the blank to be stamped, and the lubrication measurement detector is configured to transmit lubrication data on the blank to be stamped.

15. The sheet metal stamping press line according to claim 14, wherein the control unit is configured to receive the width measurement data on the blank to be stamped, the blank thickness measurement data on the blank to be stamped, and the lubrication measurement data on the blank to be stamped, and adjust the cushion tonnage of the stamping press machine, the stamping speed of the stamping press machine, and the position of the protrusion as function of at least one of the received width measurement data, the received thickness measurement data, and the received lubrication measurement data.

16. The sheet metal stamping press line according to claim 15 further comprising a draw analysis camera configured to capture an image of a stamped blank and compare the captured image to a finite element analysis of the stamped blank.

17. The sheet metal stamping press line according to claim 16, wherein the draw analysis camera is configured to transmit the comparison of the captured image of the stamped blank to the finite element analysis of the stamped blank to the control unit.

18. The sheet metal stamping press line according to claim 17, wherein the control unit is configured to receive the comparison of the captured image of the stamped blank to the finite element analysis of the stamped blank and adjust the cushion tonnage of the stamping press machine, the stamping speed of the stamping press machine, and the position of the protrusion as function of the comparison of the captured image of the stamped blank to the finite element analysis of the stamped blank.

19. The sheet metal stamping press line according to claim 17, wherein the control unit is configured to modify a production window of stamping a subsequent blank as function of the comparison of the captured image of the stamped blank to the finite element analysis of the stamped blank.

20. The forming die according to claim 1, wherein the protrusion of the female bead is movable within the recess of the female bead in the height direction of the female bead between a first position to allow for an increased amount of material to be located between the groove of the male bead and the protrusion of the female bead, and a second position to allow for a reduced amount of the material to be located between the groove of the male bead and the protrusion of the female bead.

* * * * *